US010670016B2

(12) United States Patent
Philippe

(10) Patent No.: US 10,670,016 B2
(45) Date of Patent: Jun. 2, 2020

(54) PUMP MONITORING APPARATUS AND METHOD

(71) Applicant: Edwards Limited, Burgess Hill (GB)

(72) Inventor: Laurent Marc Philippe, Gresin (FR)

(73) Assignee: Edwards Limited, Burgess Hill (GB)

( * ) Notice: Subject to any disclaimer, the term of this patent is extended or adjusted under 35 U.S.C. 154(b) by 121 days.

(21) Appl. No.: 15/558,115

(22) PCT Filed: Feb. 25, 2016

(86) PCT No.: PCT/GB2016/050491

§ 371 (c)(1),
(2) Date: Sep. 13, 2017

(87) PCT Pub. No.: WO2016/146967

PCT Pub. Date: Sep. 22, 2016

(65) Prior Publication Data

US 2018/0066658 A1 Mar. 8, 2018

(30) Foreign Application Priority Data

Mar. 18, 2015 (EP) ..... 1504533

(51) Int. Cl.

| | |
|---|---|
| ***F04B 51/00*** | (2006.01) |
| ***F04C 28/28*** | (2006.01) |
| ***F04B 49/06*** | (2006.01) |

(52) U.S. Cl.

CPC ..... *F04C 28/28* (2013.01); *F04B 49/065* (2013.01); *F04B 51/00* (2013.01)

(58) Field of Classification Search

CPC ..... F04B 49/065; F04B 51/00; F04C 28/28
See application file for complete search history.

(56) References Cited

U.S. PATENT DOCUMENTS

| | | | | |
|---|---|---|---|---|
| 6,709,240 | B1 * | 3/2004 | Schmalz | F04B 49/065 318/432 |
| 6,757,665 | B1 | 6/2004 | Unsworth et al. | |
| 7,539,549 | B1 | 5/2009 | Discenzo et al. | |
| 8,892,263 | B1 * | 11/2014 | Morris | F04D 15/0218 700/282 |

(Continued)

FOREIGN PATENT DOCUMENTS

| | | | |
|---|---|---|---|
| EP | 1972793 | A1 | 9/2008 |
| EP | 2818730 | A1 | 12/2014 |
| WO | 2016146967 | A1 | 9/2016 |

OTHER PUBLICATIONS

International Search Report and the Written Opinion of the International Searching Authority dated May 3, 2016 in counterpart International Application No. PCT/GB2016/050491, 11 pps.

(Continued)

*Primary Examiner* — David J Bolduc
(74) *Attorney, Agent, or Firm* — Shumaker & Sieffert, P.A.

(57) ABSTRACT

A monitoring apparatus comprises at least one sensor for measuring a current of the electric motor to generate a time-based signal and at least one electronic processor configured to transform the time-based signal into a frequency-based signal and to analyse the frequency-based signal to identify a signal pattern representing a pump fault condition. By monitoring the frequency-based signal, the monitoring apparatus can identify a pump fault condition.

19 Claims, 4 Drawing Sheets

(56) References Cited

U.S. PATENT DOCUMENTS

2003/0175125 A1* 9/2003 Kwon ..... F04B 35/045 417/44.11
2004/0090197 A1* 5/2004 Schuchmann ..... F04B 49/065 318/432
2004/0199480 A1* 10/2004 Unsworth ..... F04D 15/0077 706/16
2004/0230384 A1* 11/2004 Haynes ..... F04B 17/03 702/57
2007/0194772 A1 8/2007 Fix et al.
2008/0315816 A1* 12/2008 Hashimoto ..... H02P 21/0003 318/461
2009/0304524 A1* 12/2009 Wilder ..... F04C 28/06 417/44.11
2010/0082275 A1* 4/2010 Borsting ..... F04D 15/0066 702/56
2010/0166570 A1* 7/2010 Hampton ..... F04B 49/065 417/36
2017/0246383 A1* 8/2017 Lanier, Jr. ..... F04B 17/00

OTHER PUBLICATIONS

Combined Search and Examination Report under Sections 17 and 18(3) dated Aug. 27, 2015 in counterpart GB Application No. 1504533.9, 7 pps.
Translation of Office Action dated Nov. 4, 2019 received in counterpart TW application No. 105104814, 4 pp.
Translation of Office Action dated 27 Jan. 2020 received in counterpart JP application No. 2017-549273, 3 pages.

* cited by examiner

PUMP MONITORING APPARATUS AND METHOD

This application is a national stage entry under 35 U.S.C. § 371 of International Application No. PCT/GB2016/050491, filed Feb. 25, 2016, which claims the benefit of G.B. Application 1504533.9, filed Mar. 18, 2015. The entire contents of International Application No. PCT/GB2016/050491 and G.B. Application 1504533.9 are incorporated herein by reference.

TECHNICAL FIELD

The present disclosure relates to a pump monitoring apparatus; and to a pump apparatus comprising a pump monitoring apparatus. More particularly, but not exclusively, the present disclosure relates to a pump monitoring apparatus for monitoring a vacuum pump, and to a vacuum pump apparatus comprising a pump monitoring apparatus. The present disclosure also relates to an inverter comprising a pump monitoring apparatus.

BACKGROUND

It is known to diagnose a mechanical condition of a pump by monitoring vibrations and/or noise. However, these methods are expensive and can be difficult to implement on-site as they require additional transducers as well as elaborate signal processing devices. Furthermore, in order to perform a complete monitoring of the pump would require a large number of vibration transducers at locations, for example bearings, gearboxes, stator frame, etc.

A self-diagnosis method for a dry-vacuum pump is known from U.S. Pat. No. 8,721,295. The method comprises monitoring a current of a motor for rotating a rotor of the pump in conjunction a system pressure. The method seeks to identify one-off events in the form of peaks in the measured current; or to determine when the measured current exceeds a predefined threshold.

US 2008/0294382 discloses a method and apparatus for pump fault prediction. A model may be defined for managing a plurality of qualitative variables (e.g., process variables) from a relatively large number of pumps with improved predictability. To define the model, a principal component analysis (PCA) may be used to consider the correlation of multivariate data. A management variable can be selected to represent variations of the selected principal components. A controller may determine that the pump is operating in an abnormal state if the management variable exceeds an upper control line. A sensor can be connected to the pump to collect data in real time for qualitative variables associated with the pump and a corresponding semiconductor fabricating process. A replacement time for a pump may be predicted before a pump fault actually occurs by using an information system to collect data related to the process variables and statistically processing the collected data.

SUMMARY

Aspects of the present disclosure relate to a pump monitoring apparatus for a pump; to a pump apparatus comprising a pump monitoring apparatus; and to an inverter comprising a pump monitoring apparatus. Aspects of the present disclosure find particular application with gas pumps, specifically vacuum pumps and compressors.

According to one aspect of the present disclosure there is provided a vacuum pump monitoring apparatus, said vacuum pump having an electric motor to drive the pump, the monitoring apparatus comprising:

at least one sensor for measuring a current of the electric motor to generate a time-based signal; and at least one electronic processor configured to:

transform the time-based signal into a frequency-based signal; and analyse the frequency-based signal to identify a signal pattern representing a pump fault condition.

According to a further aspect of the present disclosure there is provided a pump monitoring apparatus for a vacuum pump having an electric motor, the monitoring apparatus comprising:

at least one sensor for measuring a current of the electric motor to generate a time-based signal; and at least one electronic processor configured to:

transform the time-based signal into a frequency-based signal; and analyse the frequency-based signal to identify a signal pattern representing a pump fault condition.

By monitoring the frequency-based signal, the monitoring apparatus can identify a pump fault condition. The signal pattern can, for example, correspond to a vibration signature associated with the pump fault condition. All potential sources of vibration present in a pumping system will impact the motor, for example through load torque and shaft speed variations. The energy required to drive the vibrations is provided by the electric motor and necessarily translates into its electrical power signature. The identified vibration signature can result from operation of the electric motor and/or the pump. At least in certain embodiments, the monitoring apparatus can diagnose a fault in the pump. Alternatively, or in addition, the monitoring apparatus can predict a fault in the pump.

The current of the electric motor is measured with respect to time to generate the time-based signal. The at least one electronic processor is configured to perform a frequency decomposition of the current waveform. The time-based signal generated by the current sensor is thereby transformed to a frequency-based signal. The analysis of the frequency-based signal can identify a signal pattern indicative of a known pump fault condition. The signal pattern can correspond to a vibration signature suitable for providing an indication of the status of the pump, for example a pump which is about to fail due to wear of internal components will have a different vibration signature than a brand new pump. The pump fault condition can relate to the electric motor; and/or to the pump.

The at least one electronic processor can be configured to apply a Fourier Transform algorithm in order to transform the time-based signal into a frequency-based signal. For example, a Direct Fourier Transform can be applied to the time-based signal. The implementation of a Fourier Transform of the motor current can provide a diagnostic tool for detecting and/or predicting a pump condition in a sensor-less manner.

The at least one electronic processor can be configured to divide the time-based signal into a plurality of segments for processing. The segments can be transformed independently from a time-based signal to a frequency-based signal. The transformed segments can subsequently be combined. Each segment can correspond to a predefined frequency range.

The transformation of the time-based signal and the subsequent analysis of the frequency-based signal can be performed by the same electronic processor or by different electronic processors. For example, a first electronic processor could transform the time-based signal into a frequency-based signal; and a second electronic processor could analyse the frequency-based signal. The monitoring apparatus can monitor the pump in dependence on the measured current with or without reference to additional sensors.

The signal pattern can comprise at least one signal peak in the frequency-based signal. The signal peak represents a localised increase or decrease in the amplitude of the signal for a given frequency.

The signal pattern can comprise at least one signal peak occurring at a predefined frequency or in a predefined frequency range in said frequency-based signal.

The signal pattern can comprise an amplitude of the at least one signal peak. The amplitude represents a measure of the power contributed at a given frequency.

The signal pattern can be predefined and represent a known pump fault condition. For example, the pump fault condition can be associated with eccentric operation; or a torque oscillation. The signal pattern associated with a known pump fault condition could be determined by empirical analysis. For example, the signal pattern could be determined by measuring the current for a motor in a pump having a known pump fault condition.

A fault diagnostic can be associated with the predefined signal pattern. The monitoring apparatus can output the fault diagnostic associated with the signal pattern identified in the frequency-based signal.

The monitoring apparatus can comprise one or more sensors for measuring operating parameters of the pump. At least one pump monitoring sensor can be provided to measure an operating temperature of the pump; and/or to measure performance of the pump, for example to measure an exhaust pressure of the pump. A pump monitoring sensor could also be provided to measure a rotational speed of the electric motor. The at least one processor can be configured to correlate the measured parameters with the pump fault condition to infer the source of the pump fault condition.

At least in certain embodiments, the correlation of the information relating to a variable pump state (such as temperature, pressure, power, etc.) can enable predictive monitoring of the pump.

The signal pattern can correspond to a vibration signature. The vibration signature can be that of the electric motor; or of the pump in combination with the electric motor.

The pump can be a vacuum pump. The vacuum pump can, for example, be adapted for use in a semiconductor fabrication process. The at least one electronic processor can be configured to operate continuously to transform the time-based signal into a frequency-based signal. Alternatively, the at least one electronic processor can perform the signal transform only when the pump is operating in one or more predetermined operating mode. For example, in arrangements in which the pump is a vacuum pump, the at least one electronic processor can perform the signal transform when the pump is operating below a predefined pressure threshold or within a predefined pressure range. Alternatively, the at least one electronic processor can perform the signal transform when an operating speed of the pump is within a predefined speed range or at a predefined speed. Alternatively, the at least one electronic processor can perform the signal transform when a power supply to the pump is within a predefined power range or at a predefined power level. The signal pattern can be defined for the one or more predetermined operating mode. The monitoring apparatus can be coupled to a pump controller to determine when the pump is in said predefined operating mode. Alternatively, the monitoring apparatus can determine when the pump is in said predefined operating mode in dependence on a signal from at least one pump monitoring sensor.

Viewed from a further aspect of the present disclosure there is provided an inverter for supplying current to said electric motor, wherein the inverter comprising a pump monitoring apparatus as described herein. The at least one electronic processor can be incorporated into the inverter. For example, the at least one electronic processor can be integrated into an inverter control unit. In this arrangement, the inverter control unit can implement a real-time spectral analysis algorithm, such as a Fourier Transform. The time-based signal can be transmitted to the inverter control unit at least substantially in real time.

Viewed from a further aspect of the present disclosure there is provided a pump apparatus comprising a pump monitoring apparatus as described herein. The pump apparatus can comprise an inverter connected to the electric motor. The at least one electronic processor which is configured to transform the time-based signal into a frequency-based signal can be disposed in said inverter. For example, the inverter can comprise an inverter control unit. The inverter control unit can comprise said at least one electronic processor configured for transforming the time-based signal into a frequency-based signal. The at least one electronic processor can be embedded in the inverter control unit. At least in certain embodiments, the inverter control unit can implement a real-time spectral analysis algorithm, such as a Fourier Transform. The time-based signal can be transmitted to the inverter control unit at least substantially in real time.

The analysis of the frequency-based signal could be performed in the inverter control unit. Alternatively, the inverter control unit can output the frequency-based signal, for example to a pump controller, for analysis. The inverter can be linked to the pump controller and, in use, the pump controller can request the frequency decomposition, for example when the pump is operating in said one or more predetermined operating mode. A fault diagnostic signal can be generated in dependence on the analysis of the frequency-based signal.

Viewed from a still further aspect of the present disclosure there is provided a method of monitoring a vacuum pump having an electric motor, the method comprising:

measuring a current of the electric motor to generate a time-based signal;

transforming the time-based signal into a frequency-based signal; and processing the frequency-based signal to identify a signal pattern representing a pump fault condition.

The signal pattern can comprise at least one signal peak occurring at a predefined frequency or in a predefined frequency range in said frequency-based signal.

The signal pattern can comprise an amplitude for the at least one signal peak.

The signal pattern can be a predefined signal pattern representing a known pump fault condition of the pump. A fault diagnostic can be associated with the signal pattern. The method can comprise outputting the fault diagnostic associated with the signal pattern identified in the frequency-based signal.

The method can comprise measuring one or more operating parameters of the pump and correlating the known vibration signature with said one or more operating parameters.

The method can comprise applying a Fourier Transform algorithm to transform the time-based signal into a frequency-based signal. For example, a Direct Fourier Transform can be applied to the time-based signal.

The method can comprise dividing the time-based signal into a plurality of segments for processing. The segments can be transformed independently from a time-based signal to a frequency-based signal. The transformed segments can subsequently be combined. Each segment can correspond to a predefined frequency range.

The signal pattern can correspond to a vibration signature. The vibration signature can be that of the electric motor; or the pump in combination with the electric motor.

The pump can be a vacuum pump. The vacuum pump can, for example, be adapted for use in a semiconductor fabrication process.

The method can comprise continuously transforming the time-based signal into a frequency-based signal. Alternatively, the signal transform can be performed only when the pump is operating in one or more predetermined operating mode. The signal pattern can be defined for the one or more predetermined operating mode.

The at least one electronic processor described herein can be implemented in one or more controller. To configure the at least one electronic processor, a suitable set of instructions may be provided which, when executed, cause said at least one electronic processor to implement the methods specified herein. For example, the set of instructions can, when executed, cause the at least one electronic processor to implement the transform described herein. The set of instructions may suitably be embedded in said one or more electronic processors. Alternatively, the set of instructions may be provided as software saved on one or more memory to be executed on said at least one computational device. Other suitable arrangements may also be used.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the present disclosure will now be described, by way of example only, with reference to the accompanying figures, in which.

DETAILED DESCRIPTION

Figure 1:
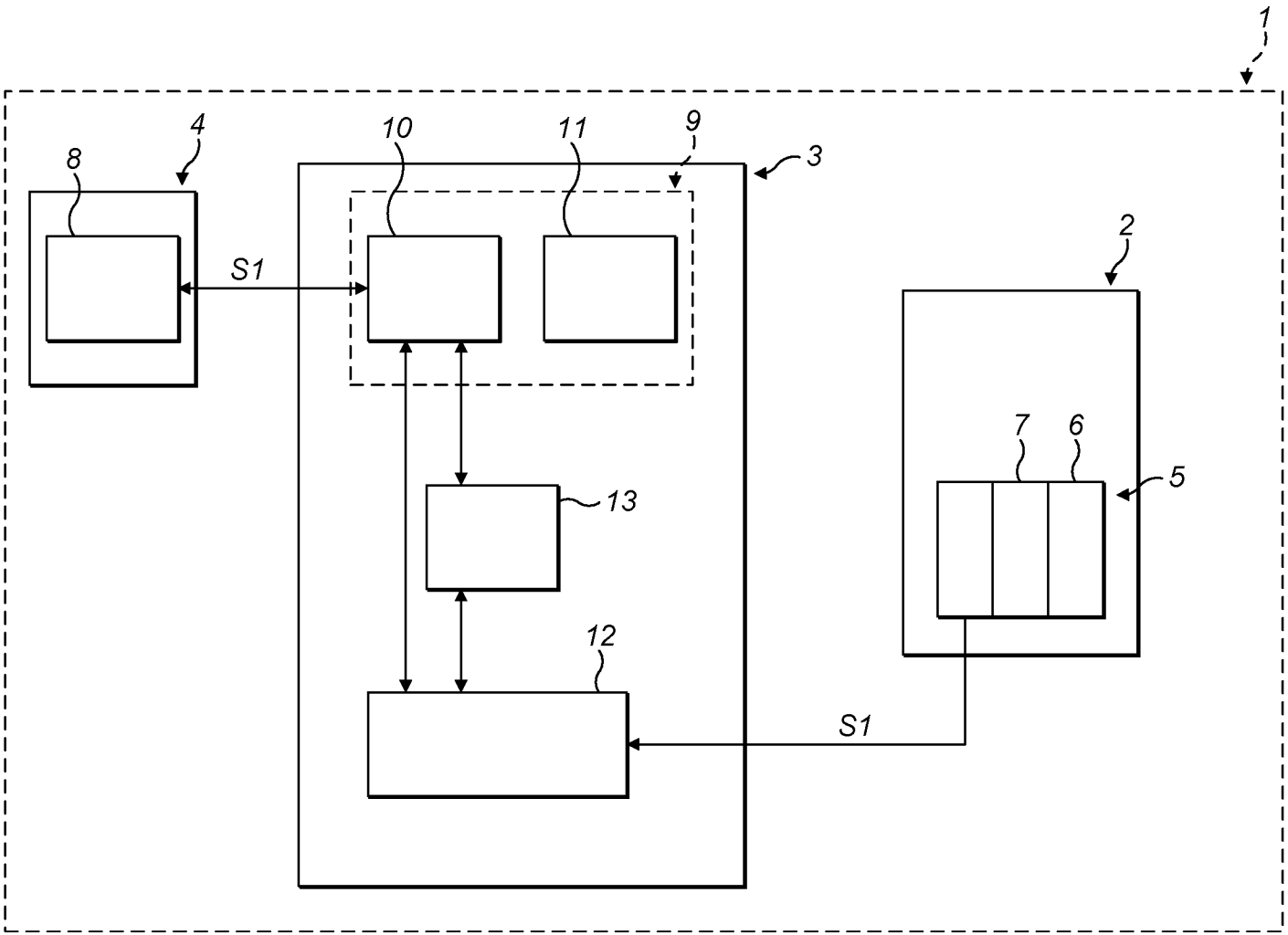
FIG. 1 shows a schematic representation of a pump system incorporating a pump monitoring device in accordance with an aspect of the present disclosure.

A pump system 1 in accordance with an embodiment of the present disclosure will now be described with reference to FIGS. 1 to 4. As described herein, the pump system 1 is configured to perform a self-diagnostic function.

The pump system 1 comprises a pump 2, an inverter 3 and a pump controller 4. The pump 2 in the present embodiment is a vacuum pump, such as a multi-stage positive displacement pump, for pumping gas from a semiconductor tool or the like.

However, it will be appreciated that the present disclosure is not limited to a particular type of pump mechanism. The pump 2 comprises an electric motor 5 having a stator 6 and a rotor 7. The pump controller 4 is connected to the inverter 3 and provides a human machine interface (HMI) to facilitate control of the pump 2. The pump controller 4 comprises a first electronic processor 8.

The inverter 3 is operative to convert direct current (DC) to alternating current (AC) to power the electric motor 5, for example to a 3-phase AC signal. The inverter 3 comprises an inverter control unit 9 having a second electronic processor 10 connected to system memory 11. The second electronic processor 10 is connected to a current sensor 12 and an electronic storage device 13. A current signal generated by the current sensor 12 can be transferred to the second electronic processor 10 at least substantially in real time. A set of operating instructions are stored in the system memory 11 and, when executed, cause the second electronic processor 10 to transform a time-based signal received from the current sensor 12 to a frequency-based signal. The second electronic processor 10 is configured to sample the stator current of the electric motor 5 from the current sensor 12 at regular time intervals to generate input data for processing by the second electronic processor 10. In the present embodiment, the sampling rate of the motor current is two (2) milliseconds (ms). In the present embodiment, the second electronic processor 10 is configured to process the input data at least substantially in real-time by applying a Discrete Fourier Transform (DFT) to generate output data which is written to the electronic storage device 13. The output data comprises amplitude and frequency data. Since the DFT processes the input data at least substantially in real-time, it is not necessary to store the input data. In a variant, the input data can optionally be written to the electronic storage device 13 as a time-based signal. The input data can be read by the second electronic processor 10 for processing. For example, the second electronic processor 10 can implement a standard forward Fourier Transform using the electronic storage device 13 to store both input and output data sets until the calculation is complete. The electronic storage device 13 can, for example, be in the form of Flash memory.

The second electronic processor 10 is configured to transform the time-based signal to a frequency-based signal. In the present embodiment, the second electronic processor 10 implements a DFT algorithm to generate the frequency-based signal. The frequency-based signal is in the form of a power spectral density (PSD) spectrum of the motor stator current comprising amplitude vs. frequency. The power spectral density describes how the time-based stator current measurements are distributed over a frequency range. According to the Nyquist-Shannon theorem the maximum frequency that can be resolved is half the sampling interval, so higher sampling intervals allow higher frequencies to be resolved. As outlined above, the sampling rate of the motor current is two (2) milliseconds and, therefore, the frequency range in the present embodiment is from 0 to 250 Hz. The specified frequency range (0 to 250 Hz) is defined for a particular pump mechanism and different frequency ranges can be selected for different pump mechanisms. A higher frequency range could be monitored for a different pump mechanism with a corresponding increase in the sampling rate. The power spectral density can be represented in graphical form as amplitude on the Y-axis; with the frequency (Hz) on the X-axis.

The DFT algorithm updates the output data set with each new input sample as the input data is received. Once each of the outputs has been updated the input sample can be discarded. It will be appreciated that the execution time and the storage space required by the DFT algorithm to build the output data set are proportional to the number of output points, i.e. to the number of frequencies for which the amplitude is calculated. In the present embodiment the frequency range to be analysed is DC to 250 Hz at a resolution of 0.1 Hz (corresponding to 2500 output points). The second electronic processor 10 is configured to divide the input data into a plurality of input data segments, each input data segment corresponds to a sub-section of the frequency range to be analysed. The DFT algorithm is repeated for each input data segment of the input data such that each iteration or pass is performed in respect of a sub-section of the frequency range. The input data segments could each relate to a single frequency point for analysis. In the present embodiment, however, each input data segment relates to approximately 100 frequency points for analysis. The DFT algorithm is applied by the second electronic processor 10 to generate a plurality of output data segments. Each output data segment corresponds to a sub-section of the frequency range. The second electronic processor 10 outputs said output data segments to the first electronic processor 8 in the pump controller 4. The first electronic processor 8 receives said plurality of output data segments and generates a cumulative output data set. The cumulative output data set covers the full amplitude vs. frequency spectrum range (from DC to 250 Hz). The first electronic processor 8 can be configured to communicate with the second electronic processor 10 to request that the one or more output data segment are output only when certain operating conditions are satisfied. For example, the first electronic processor 8 can request one or more output data segment only when the pump 2 is operating at a defined pressure or within a defined pressure range. The operating conditions can be determined in dependence on a control input or a measured parameter, such as pressure. The output data segments calculated when the operating conditions are not satisfied can be discarded.

It has been recognised that all sources of vibration present in the pump system 1 will impact the electric motor 5, for example through load torque and shaft speed variations. Thus, the energy necessary to drive the vibrations must be provided by the electric motor 5 and necessarily translates into its electrical power signature. Any vibration in the pump system 1 will establish a characterising signal pattern in the motor current. Different operating characteristics of the electric motor 5 will result in different signal patterns within the power spectral density. By analysing the power spectral density to identify one or more characterising signal pattern, a pump fault condition (or a potential pump fault condition) in the pump 2 can be identified which may result in abnormal operation. The frequency at which a signal peak (i.e. a comparatively large upward or downward amplitude change) occurs and/or the amplitude of the signal peak can be used to identify a particular vibration signature of the pump system 1. By way of example, the signal peak at a particular frequency (or within a defined frequency range) can be indicative of a particular vibration signature of the electric motor 5. The vibration signature could, for example, be the result of eccentricity in the electric motor 5, or a torque oscillation in the electric motor 5. By identifying the signal pattern associated with the vibration signature, the pump fault condition of the pump 2 can be identified or predicted. The second electronic processor 10 can thereby provide a self-diagnostic function.

The second electronic processor 10 is configured to output the power spectral density to the first electronic processor 8, for example over a serial link. The first electronic processor 8 analyses the power spectral density to identify one or more predefined signal pattern indicative of a particular vibration signature of the electric motor 5. For example, a first signal pattern can correspond to a vibration signature of the electric motor 5 due to eccentricity; and a second signal pattern can correspond to a vibration signature of the electric motor 5 due to torque oscillation. The one or more signal pattern specify: (a) a frequency (or a frequency range) in which the presence (or absence) of a signal peak is indicative of a vibration signature; and/or (b) an amplitude of a signal peak, for example defined as a discrete value, a minimum threshold, or as a range. It will be appreciated that the signal pattern could define more than one signal peak. The frequency and/or the amplitude can be generated dynamically, for example based on historical operating data for the electric motor 5; or can be predefined, for example based on empirical analysis.

In dependence on the analysis of the power spectral density, the pump controller 4 can perform self-diagnosis to identify existing or prospective faults. The first electronic processor 8 can, for example, output a notification or an alert to an operator, for example to display a fault code. The first electronic processor 8 can output a fault diagnostic signal in dependence on analysis of the frequency-based signal.

By processing the power spectral density, the first electronic processor 8 can identify a pump fault condition corresponding to one or more of the following: torque oscillation; unbalance; advanced drag/clogging/skidding; shaft alignment; a gear box fault; eccentricity; run-outs; bearing wear; build errors/drifts; electrical fault(s); stator winding fault(s), such as winding unbalance (for example due to shorts between turns); broken rotor bar; broken end-ring; and motor rotor fault(s).

The second electronic processor 10 can diagnose and/or predict faults in the pump 2 in dependence only on the output from the current sensor 12. This is a particular advantageous over prior art apparatus which requires additional sensors to monitor vibrations of the electric motor 5. In a variant of the present embodiment, the second electronic processor 10 can optionally be configured to receive a signal from a different sensor to determine additional pump operating parameters. A temperature sensor can be provided to measure the temperature of the electric motor 5 and output an operating temperature signal to the second electronic processor 10. A pressure sensor can be provided to measure an exhaust (outlet) pressure from the pump 2 and output an operating pressure signal to the second electronic processor 10. The second electronic processor 10 can correlate the pump operating parameter with the results of processing the power spectral density spectrum. This approach can facilitate diagnosis and/or prediction of a pump fault condition in the pump 2, for example to differentiate between vibration signatures.

The operation of the pump system 1 in accordance with an embodiment of the present disclosure will now be described with reference to FIGS. 2, 3 and 4. In particular, the operation of the second electronic processor 10 to identify predefined signal patterns present in a series of power spectral density spectra will now be described. Like reference numerals are used for like features in the respective power spectral density spectra, albeit incremented by 110 in each figure for clarity.

Figure 2:
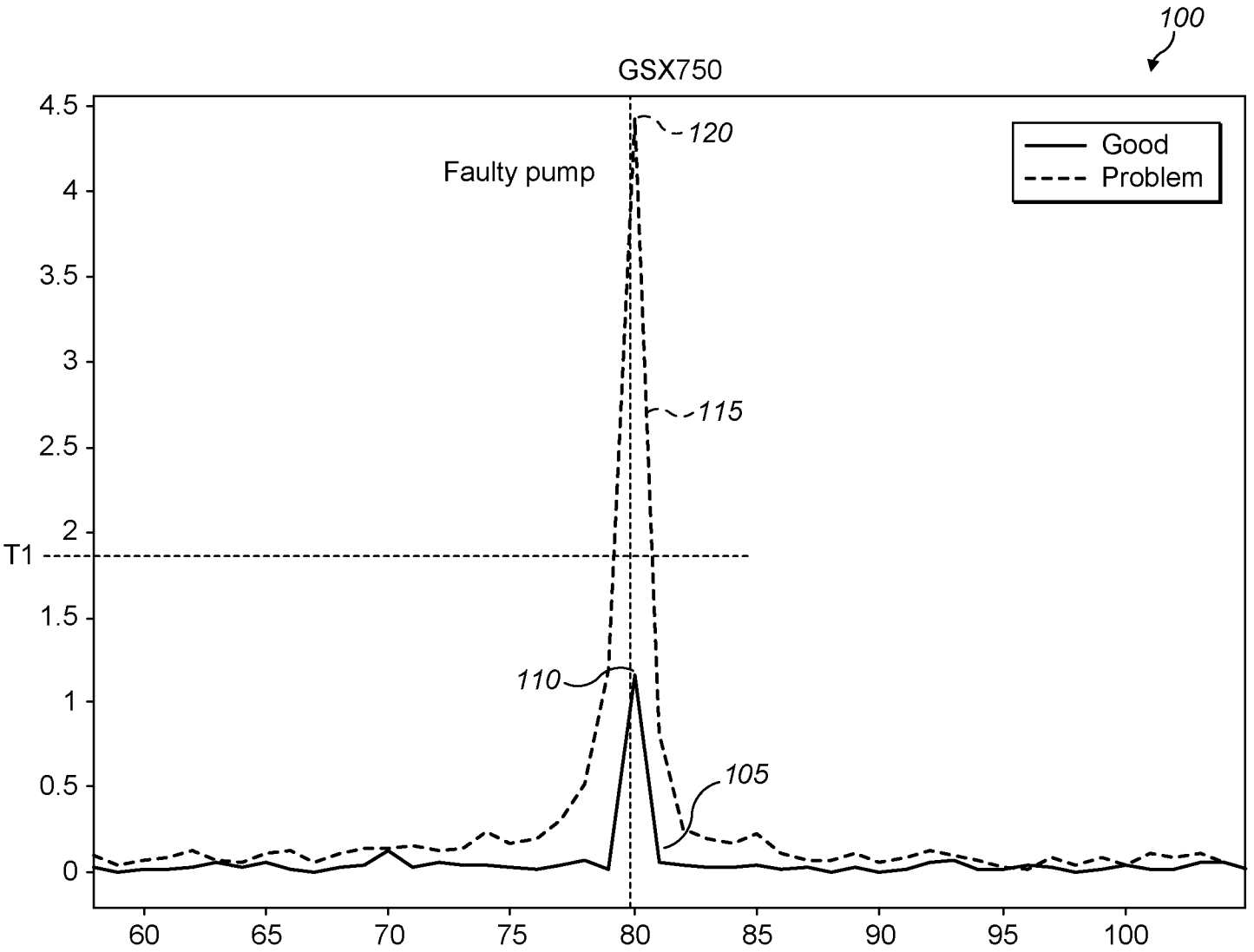
FIG. 2 shows a first power spectral density spectrum generated in dependence on the stator current of the pump system shown in FIG. 1.

A first power spectral density spectrum 100 is shown in FIG. 2 by way of example. A first frequency-based signal 105 is shown for normal operation of the pump 2. The first frequency-based signal 105 comprises a first peak 110 which represents a standard vibration signature of the electric motor 5. A second frequency-based signal 115 represents abnormal operation of the pump 2. The first peak 110 is present in the second frequency-based signal 115 but the amplitude is markedly increased. To identify or predict the pump fault condition, the second electronic processor 10 analyses the power spectral density spectrum to determine if the magnitude of the second peak 120 is greater than a first predefined threshold Ti.

Figure 3:
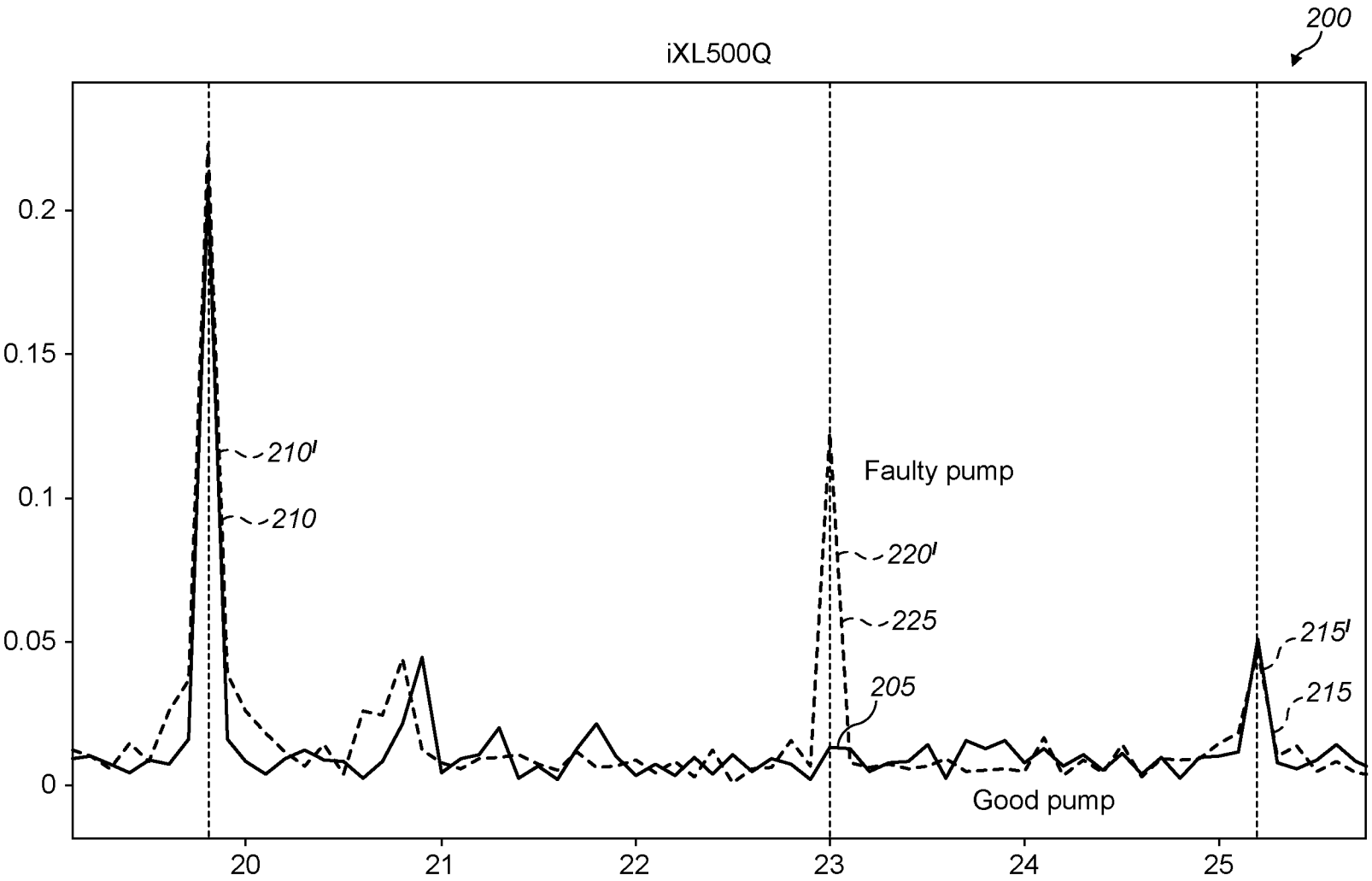
FIG. 3 shows a second power spectral density spectrum generated in dependence on the stator current of the pump system shown in FIG. 1.

A second power spectral density spectrum 200 is shown in FIG. 3 by way of example. A first frequency-based signal 205 represents a standard vibration signature of the electric motor 5. The first frequency-based signal 205 comprises a first peak 210 (at approximately 20 Hz) and a second peak 215 (at approximately 25 Hz). A second frequency-based signal 225 represents abnormal operation of the pump 2. The second frequency-based signal 225 comprises a first peak 210' (at approximately 20 Hz), a second peak 215' (at approximately 25 Hz) and a third peak 220' (at approximately 23 Hz). The amplitude of the first and second peaks 210', 215' in the second frequency-based signal 225 is substantially the same as those present in the first frequency-based signal 205. However, the third peak 220' is only present in the second frequency-based signal 225. To identify or predict the pump fault condition, the first electronic processor 8 analyses the power spectral density spectrum to determine if the third peak 220' is present at a predefined frequency (approximately 23 Hz in the present embodiment). If the third peak 220' is identified, the first electronic processor 8 diagnoses or predicts the corresponding pump fault condition for the pump 2.

Figure 4:
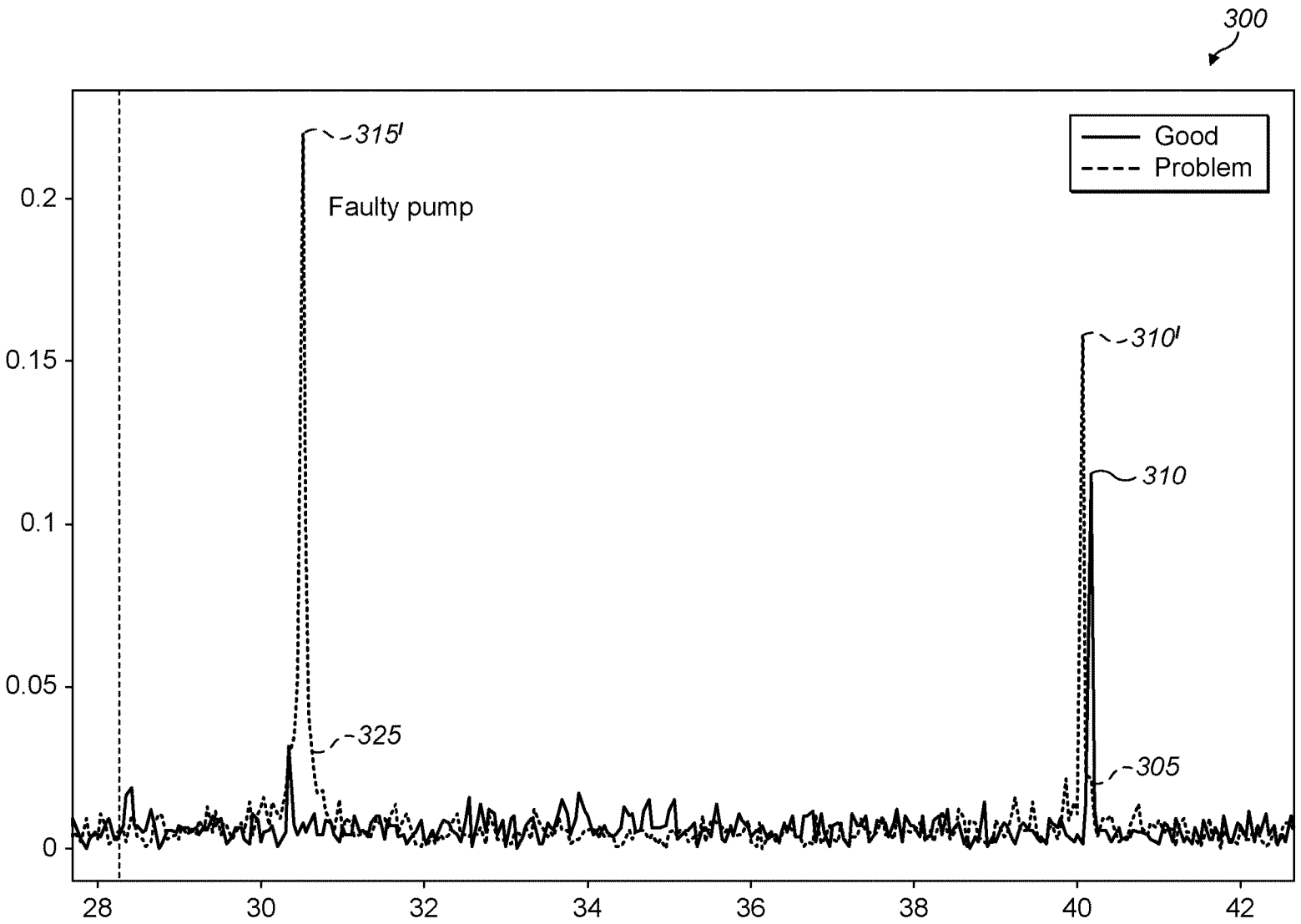
FIG. 4 shows a third power spectral density spectrum generated in dependence on the stator current of the pump system shown in FIG. 1.

A third power spectral density spectrum 300 is shown in FIG. 4 by way of example. A first frequency-based signal 305 represents a standard vibration signature of the electric motor 5. The first frequency-based signal 305 comprises a first peak 311 310 (at approximately 40 Hz). A second frequency-based signal 325 represents abnormal operation of the pump 2. The second frequency-based signal 325 comprises a first peak 310' (at approximately 40 Hz) and a second peak 315' (at approximately 31 Hz). The amplitude of the first peak 310' in the second frequency-based signal 325 is substantially the same as those present in the first frequency-based signal 305. However, the second peak 315' is only present in the second frequency-based signal 325. To identify or predict the pump fault condition, the first electronic processor 8 analyses the power spectral density spectrum to determine if the second peak 315' is present at a predefined frequency (approximately 31 Hz in the present embodiment). If the second peak 315' is identified, the first electronic processor 8 diagnoses or predicts the corresponding pump fault condition for the pump 2.

The embodiment of the pump system 2 has described application of a Fourier transform to generate the frequency-based signal. It will be appreciated that alternate analysis techniques can be employed to transform the time-based signal to the frequency-based signal. By way of example, suitable mathematical transforms include Hartley, Sin/Cos, etc.

It will be appreciated that various changes and modifications can be made to the pump system 1 described herein without departing from the scope of the present application. In the embodiment described herein the power spectral density is generated by the second electronic processor 10 and then output to the first electronic processor 8 for analysis. These functions could both be performed by the same processor, either the first electronic processor 8 or the second electronic processor 10. Alternatively, a discrete diagnostic unit could be used to generate the power spectral density and to perform the related analysis.

The invention claimed is:

1. An inverter for supplying current to an electric motor of a vacuum pump, wherein the inverter comprises:
- a pump monitoring apparatus comprising:
  - at least one sensor configured to measure a current of the electric motor and generate a time-based signal; and
  - at least one electronic processor configured to:
    - transform the time-based signal into a frequency-based signal; and
    - analyze the frequency-based signal to identify a signal pattern representing a pump fault condition.

2. The inverter as claimed in claim 1, wherein the signal pattern comprises at least one signal peak in the frequency-based signal.

3. The inverter as claimed in claim 2, wherein the signal pattern comprises at least one signal peak occurring at a predefined frequency or in a predefined frequency range in the frequency-based signal.

4. The inverter as claimed in claim 2, wherein the signal pattern comprises an amplitude for the at least one signal peak.

5. The inverter as claimed in claim 1, wherein the signal pattern is predefined and represents a known pump fault condition.

6. The inverter as claimed in claim 5, wherein a fault diagnostic is associated with the predefined signal pattern.

7. The inverter as claimed in claim 6, further comprising outputting the fault diagnostic associated with the signal pattern identified in the frequency-based signal.

8. The inverter as claimed in claim 5, further comprising one or more pump monitoring sensor configured to measure one or more operating parameter of the pump, the at least one processor being configured to correlate the pump fault condition with the one or more operating parameter.

9. The inverter as claimed in claim 1, further comprising an inverter control unit, wherein the at least one electronic processor is integrated into the inverter control unit.

10. A pump apparatus comprising:
- an electric motor; and
- an inverter configured to supply current to the electric motor, wherein the inverter comprises:
  - a pump monitoring apparatus comprising:
    - at least one sensor configured to measure a current of the electric motor and generate a time-based signal; and
    - at least one electronic processor disposed in the inverter and configured to:
      - transform the time-based signal into a frequency-based signal; and
      - analyze the frequency-based signal to identify a signal pattern representing a pump fault condition.

11. A method of monitoring a vacuum pump having an electric motor, the method comprising:

measuring, by at least one sensor, a current of the electric motor to generate a time-based signal;

transforming, by at least one electronic processor within an inverter, the time-based signal into a frequency-based signal; and processing, by the at least one electronic processor within the inverter, the frequency-based signal to identify a signal pattern representing a pump fault condition.

12. The method as claimed in claim 11, wherein the signal pattern comprises at least one signal peak in the frequency-based signal.

13. The method as claimed in claim 12, wherein the signal pattern comprises at least one signal peak occurring at a predefined frequency or in a predefined frequency range in the frequency-based signal.

14. The method as claimed in claim 12, wherein the signal pattern comprises an amplitude for the at least one signal peak.

15. The method as claimed in claim 11, wherein the signal pattern is predefined and represents a known pump fault condition.

16. The method as claimed in claim 15, wherein a fault diagnostic is associated with the predefined signal pattern.

17. The method as claimed in claim 16, further comprising outputting the fault diagnostic associated with the signal pattern identified in the frequency-based signal.

18. The method as claimed in claim 15, further comprising measuring, by one or more pump monitoring sensor, one or more operating parameter of the pump and correlating the known pump fault condition with the one or more operating parameters.

19. The inverter of claim 1, wherein the at least one electronic processor is configured to sample the stator current of the electric motor at regular intervals to generate input data, to process the input data substantially in real time by applying a Discrete Fourier Transform to the input data to generate output data, and to store the output data and discard the input data from which the output data stemmed.

* * * * *